United States Patent [19]

Wolff

[11] Patent Number: 5,048,715

[45] Date of Patent: Sep. 17, 1991

[54] CLOSURE ASSEMBLY WITH HINGED COVER

[75] Inventor: Martin J. Wolff, North Providence, R.I.

[73] Assignee: Dart Industries, Inc., Deerfield, Ill.

[21] Appl. No.: 405,618

[22] Filed: Sep. 7, 1989

[51] Int. Cl.[5] ..... B65D 43/24

[52] U.S. Cl. ..... 220/335; 220/338; 220/306; 16/267

[58] Field of Search ..... 220/334, 335, 337, 338, 220/340, 342, 343; 16/260, 261, 267, 341, 342, 344

[56] References Cited

U.S. PATENT DOCUMENTS

| | | | |
|---|---|---|---|
| 2,263,946 | 11/1941 | Fletcher | 16/267 |
| 2,342,477 | 2/1944 | Magenat | 220/338 |
| 2,527,318 | 10/1950 | Magnus | 220/338 |
| 2,677,479 | 5/1954 | Kiba | 220/338 |
| 2,734,222 | 2/1956 | Kiba | 220/338 |
| 3,333,726 | 8/1967 | Belanger | 220/337 |
| 3,365,094 | 1/1968 | Palson | 220/337 |
| 4,282,983 | 8/1981 | Swartzbaugh | 220/335 |
| 4,293,079 | 10/1981 | Lytle | 220/339 X |
| 4,349,120 | 9/1982 | DiNardo | 220/337 |
| 4,399,928 | 8/1983 | Klingler | 220/335 |
| 4,540,090 | 9/1985 | Gelardi et al. | 220/338 X |
| 4,663,803 | 5/1987 | Gora | 220/338 X |

*Primary Examiner*—Stephen Marcus
*Assistant Examiner*—Nova Stucker
*Attorney, Agent, or Firm*—John A. Doninger

[57] ABSTRACT

A closure assembly for an open-top container including an adapter ring with a depending groove for engagement about the rim of the container. The adapter ring further includes a pair of integral hinge seats having opposed detents which receive and rotationally position a pair of pivot pins integral with an overlying cover. Each pivot pin includes a detent-received shaft portion for rotational manipulation of cover, and a cam selectively engageable with a second detent in the open position of the cover for retention of the cover. The pin cam, in the corresponding detent recess, provides a second pivot axis for complete disengagement of the cover.

21 Claims, 3 Drawing Sheets

CLOSURE ASSEMBLY WITH HINGED COVER

BACKGROUND OF THE INVENTION

The invention is broadly concerned with the provision of hinged covers for plastic canisters, either open-topped or of the type including removable snap-on lids.

The conventional snap-on lid, being a completely separable item, gives rise to several potential problems such as being misplaced, being improperly aligned on and sealed to the canister, etc.

While hinged lids for plastic containers are known, such lids, upon an unlatching thereof and an outward swinging to an open position, are free-swinging, and must be manually held, if the contents of the container are to be scooped or poured out, or the open container is to be otherwise manipulated.

In addition, with conventional hinged lid construction, no provision is made for a controlled complete removal of the lid as a simple manipulative step such as might be desired with particular goods or for cleaning purposes or the like.

SUMMARY OF THE INVENTION

The present invention proposes a closure assembly which mounts on a conventional open-top canister or container in place of the conventional removable snap-on lid. The closure assembly incorporates a hinged or pivotally mounted cover for allowing selective access to the interior of the canister without complete separation of the cover therefrom.

The cover is mounted by a hinge assembly which, in addition to allowing for pivotal movement of the cover between open and closed positions, also provides for a releasable locking of the cover in a maximum open position for both free access to the interior of the canister and manipulation of the canister, as for scooping or pouring the contents therefrom, without movement of the cover from its maximum open position.

The practicality of the closure assembly is enhanced by incorporating, in the hinge assembly, means whereby complete removal of the hinged cover can be effected through a simple manipulation thereof, thus allowing for use of the hinged cover, in the manner of a conventional hinged lid while also providing for complete removal of the cover as might be dictated under particular circumstances.

In achieving the objects of the invention, the closure assembly includes an adapter in the nature of a ring configured to interlock with the rim of a canister about the open top thereof. The adapter, in turn, pivotally mounts a cover for the open top utilizing a hinge assembly incorporating a pair of oppositely directed hinge pins on the cover pivotally engaged within a cooperating pair of pin-receiving seats on the adapter whereby an affixing of the adapter to the canister automatically provides the canister with a pivotal closure cover.

The hinge assembly provides for three distinct positional relationships between the cover and the adapter and hence the container, a first position wherein the cover is releasably fixed in its closed position, a second position wherein the cover is releasably fixed in its maximum open position approximately 105 degrees from the open top of the container, and a third position beyond the fixed open position wherein the cover-mounted hinge pins are released from the seats for complete removal of the cover.

The three positions are defined, in each hinge pin and seat combination, by a pair of generally opposed detents in the seat, which cooperate with the hinge pin and an integral cam projection formed thereon. The hinge pin, in the closed position of the cover, is rotatably retained within the first detent. Upon movement of the cover to its maximum open position, the cam projection snap-engages into the second detent while the hinge pin is retained in the first detent, thus locking the cover in its open position. Upon movement of the cover beyond the maximum open position, the hinge pin rotates about the second or cam projection detent and disengages from the first or pin detent, allowing the hinge pin to drop from the seat and the cam projection to slide from the second detent.

Other features of the invention, and further advantages derived therefrom will become apparent from the more detailed description following hereinafter.

DESCRIPTION OF PREFERRED EMBODIMENTS

Figure 1:
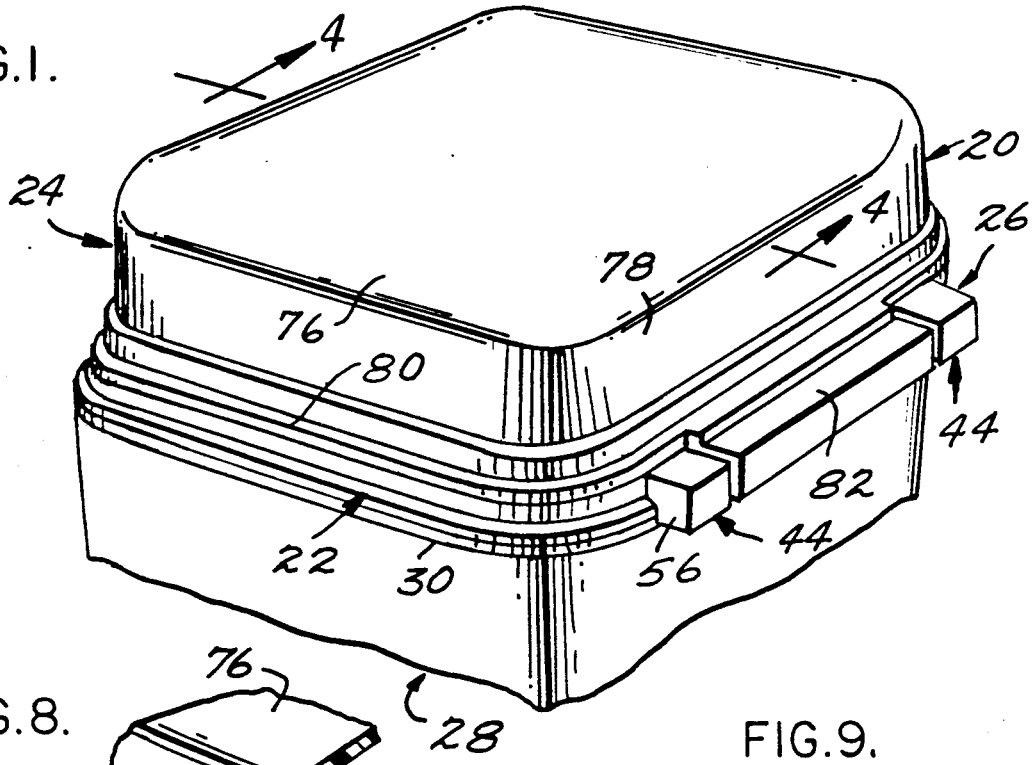
FIG. 1 is a top perspective view of the closure assembly of the invention mounted on a canister.
Figure 8:
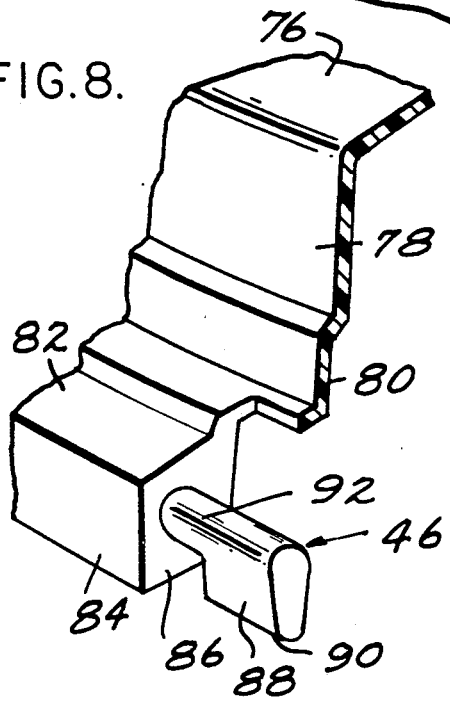
FIG. 8 is a perspective detail of one of the pivot pins.
Figure 9:
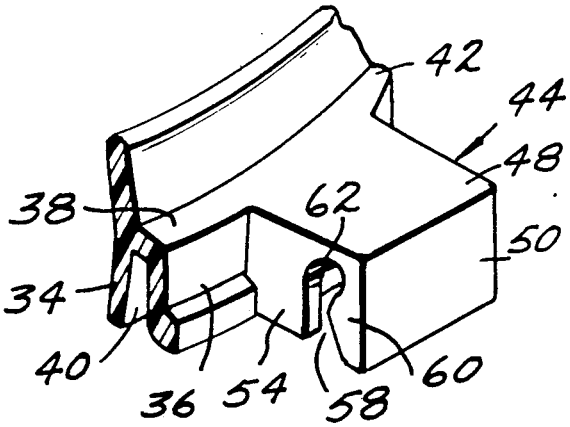
FIG. 9 is a perspective detail of one of the pin-receiving seats.
Figure 10:
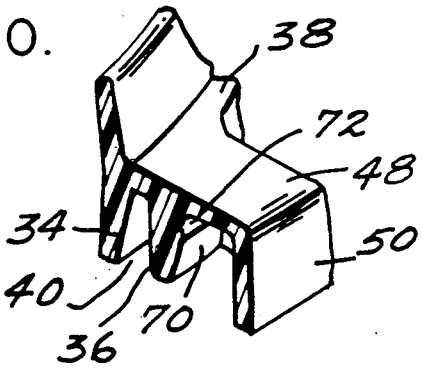
FIG. 10 is a sectional perspective through the seat of FIG. 9.
Figure 2:
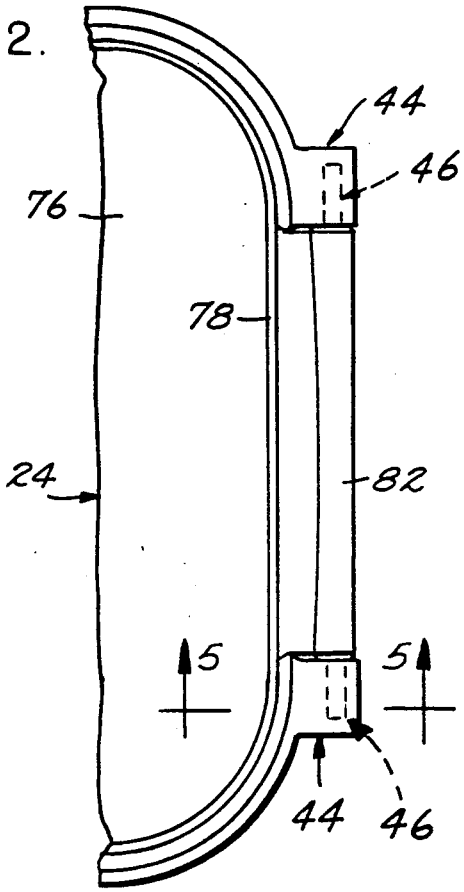
FIG. 2 is an enlarged partial top plan view of the construction of FIG. 1 at the hinge assembly.
Figure 3:
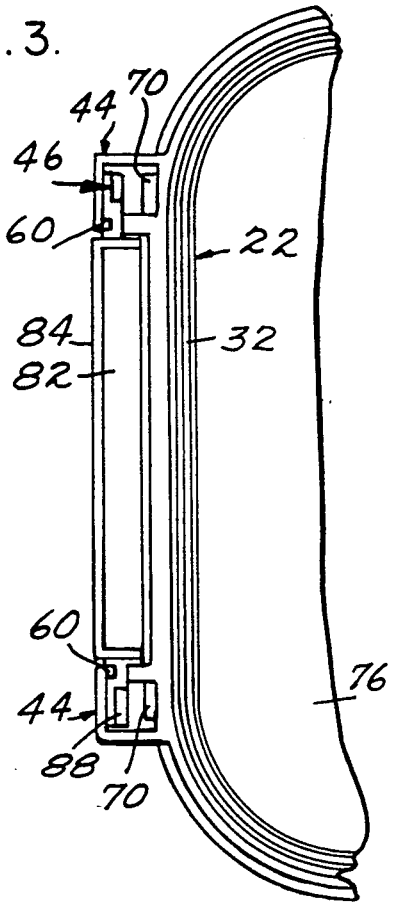
FIG. 3 is a bottom plan view of the structure of FIG. 2 with the canister removed and illustrating only the adapter ring and cover.

Referring more specifically to the drawings, the closure assembly 20 of the invention comprises an adapter or adapter ring 22 and a cover 24 with a dual detent releasable hinge assembly 26 therebetween.

The closure assembly 20 mounts on the open upper end of a conventional canister or container 28 as a closure means, replacing the normally provided snap-on lid. It is also of course contemplated that the closure assembly be adapted for accommodation on containers of the type not normally having lids associated therewith. In each instance, the adapter ring 22, with regard to that portion thereof which engages the container rim, will be configured to approximately affix and seal to the rim. The illustrated container 28 is of the type typically including a snap-on lid, and has a laterally outwardly projecting flange 30 peripherally about the side walls thereof with a slightly outwardly flared rim or rim portion 32 immediately thereabove.

The adapter or adapter ring 22 is peripherally coextensive with the container rim 32 for engagement therewith. The adapter ring 22 includes integrally formed inner and outer walls 34 and 36 interconnected by a transverse top wall 38 defining a downwardly directed rim-receiving recess or groove 40. The walls 34 and 36, and in particular the inner facing surfaces thereof, are parallel and inclined to conform to the inclination of the container rim 32 whereby an intimate mating engagement of the rim 32 within the groove 40 is achieved. It is contemplated that the lower edge of the outer wall 36 be slightly flared to facilitate mounting of the adapter 22. This lower edge seats on the flange 30 simultaneously with engagement with the upper edge of the rim 32 with the undersurface of the top wall 38 upon a full seating of the adapter 22 on the rim 32. The inner wall 34 of the adapter 22 extends vertically above the top wall 38 and defines therewith an outwardly and upwardly directed cover-receiving seat 42 within which the cover 24 peripherally seats in its closed position.

The hinge assembly 26 is defined along one linear extent of the closure assembly 20 and consists of a pair of longitudinally spaced hinge units, each comprising a hinge seat 44 on the adapter 22 and a hinge pin 46 on the cover 24. Each hinge seat 44 includes a top panel 48 which is an integral coplanar outwardly extention of the top wall 38 of the adapter 22. An outer panel 50 is integral with and depends from the outer edge of the top panel 48 in generally parallel relation to a corresponding inwardly aligned length of the adapter outer wall 36. Noting FIG. 5 in particular, it will be seen that the portion of the adapter wall 36 comprising a component of the hinge seat is perpendicular to the top wall 38, rather than following the rim-contemplating inclination of the corresponding portion of the adapter inner wall 34. This is significant in providing for a slight spacing or gap 52 between the groove-received canister rim 32 and the outer wall 36 within the hinge seat to enhance the inherent flexibility of this wall portion during pivotal manipulation of the cover as shall be explained subsequently.

A near panel 54, that is a panel facing inwardly toward the other of the hinge seats, extends between the outer wall 36 of the adapter 22 and the outer panel 50 of the hinge seat 44 and is integrally molded with the wall 36, panel 50 and top panel 48 along the near edges of the top and outer panels 48 and 50. A similar integrally molded far panel 56 is provided in spaced substantially parallel relation to the near panel 54 whereby a downwardly opening hinge housing is defined.

The near panel 54 includes a vertical slot 58 therein extending upward from the free lower edge of the panel 54 adjacent the outer panel 50. The slot 58 terminates in a generally rounded upper end immediately below the top panel 48. At an intermediate point between the top panel 48 and the lower edge of the near panel, an inwardly extending lobe 60 is formed restricting the width of the near panel slot 58 and defining a substantially circular detent or detent recess 62 thereabove. The lobe 60 includes an inner or slot-defining surface tapering from the upper and lower extremities for cooperative engagement with the hinge pin 46 as shall be discussed subsequently.

A second detent 66 is defined beyond the near panel 54 and between the near panel 54 and the far panel 56. This detent 66 is formed by an integral projection 68 formed on the corresponding portion of the adapter outer wall 36 and includes a lobe 70 oppositely directed relative to the lobe 60 at a height, relative to the lobe 60, closer to the top panel 48. The lobe 70 defines an arcuate detent-defining recess 72. The projection 68, for appropriate cooperative engagement with the pivot pin 46, also includes a sloping inner surface 74 from the lower edge thereof to the lobe 70 immediately below the arcuate recess 72.

It will be appreciated that the hinge seats 44 are mirror-duplicates of each other, oppositely inwardly directed to accommodate a pair of complementary oppositely directed pivot pins 46.

The cover 24 includes a top 76 with a depending peripheral skirt 78 terminating in a slightly outwardly offset lower end portion 80 which is peripherally received within the peripheral upwardly and outwardly directed adapter seat 42 defined by the top wall 38 and adjoining upwardly projecting portion of the inner wall 32 of the adapter 22.

The cover 24, between the hinge seats 44, includes a rearwardly extending top panel 82 integral with the lower edge of the skirt 78 and terminating in a depending outer panel 84, both of which, in the closed position of the cover 24, are generally coplanar with the top and outer panels 48 and 50 of the spaced hinge seats 44.

The opposed ends of the top and outer panels 82 and 84 are closed by integral end panels 86 positioned, in the mounted cover, in closely spaced parallel relation to the near panels 54 of the two hinge seats 44.

A hinge or pivot pin 46 is fixed, preferably integrally, with each end panel 86 and projects longitudinally therefrom for engagement within the corresponding hinge seat 44. The hinge or pivot pin 46 is cylindrical and extends generally centrally from the corresponding end panel 86. In outwardly spaced relation to the end panel 86, the pivot pin 46 includes a integral laterally directed tapered cam or cam projection 88 terminating in a reduced radius arcuate free edge 90. The outward spacing of the cam 88 from the end panel 86 defines a cylindrical pin shaft portion 92 of a length slightly greater than the thickness of the near panel 54 of the corresponding hinge seat 44. Further, the diameter of the shaft portion 92 is such as to be closely although rotatably and slidably received within the corresponding seat slot 58 at its maximum width for introduction therein and for snap-locking into the formed arcuate detent recess 62. Upward movement of the shaft portion 92 of the hinge pin 46 in the slot 54 engages the shaft portion 92 with the camming surface of the detent lobe 60 causing a sufficient degree of flexure, primarily in the outer panel 50 of the hinge seat 44, for an engagement of the shaft portion 92 within the detent recess 62.

Figure 6:
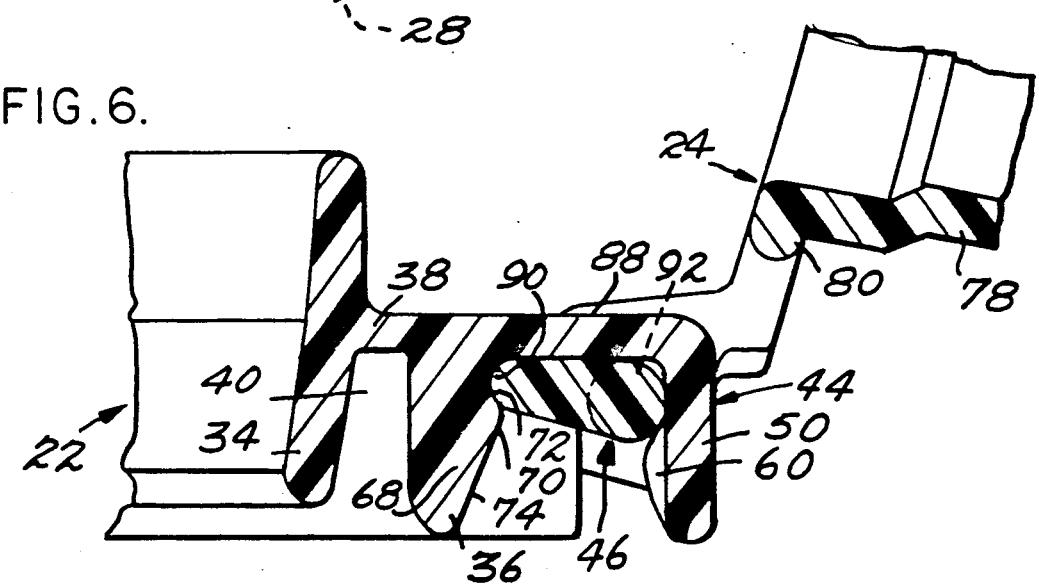
FIG. 6 is a cross-sectional detail similar to FIG. 5 illustrating the cover in its maximum open position.
Figure 7:
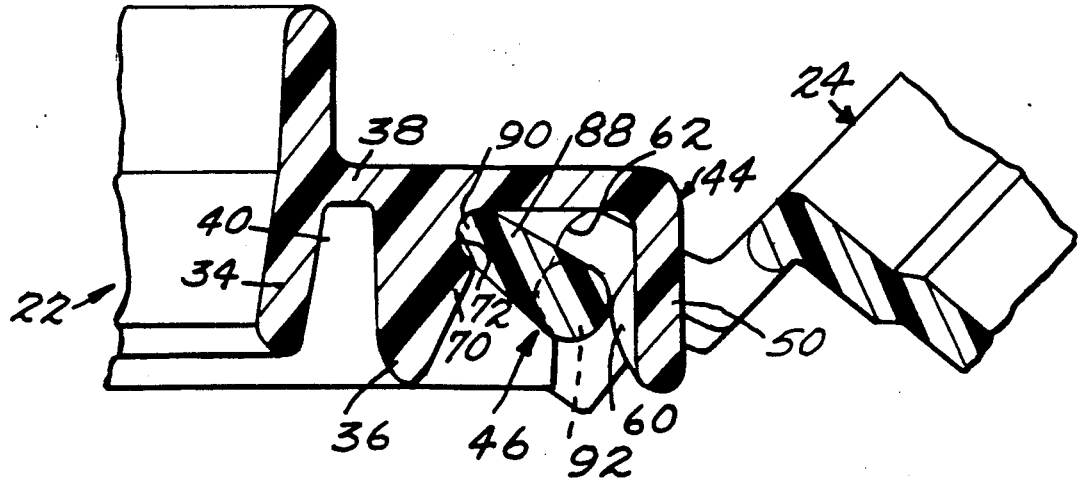
FIG. 7 is a cross-sectional detail similar to FIG. 6 illustrating the cover moved toward its released position.

More specifically, when the cover 24 is to be mounted on the adapter ring 22, the cover is inverted relative to the adapter 22 with the hinge pins 46 in vertical alignment below the corresponding hinge seats 44. Now noting FIG. 7 in particular, each hinge pin 46, simultaneously with the other hinge pin, is moved upwardly into the open lower end of the corresponding hinge seat 44 with the shaft portion 92 aligned with the open lower end of the slot 58. The cam 88 is received within the seat 44 in slightly spaced relation beyond the near panel 54 with the arcuate reduced free end 90 of the cam 88 initially seating in the detent recess 72 defined at the upper end of the projection 68 on the corresponding portion of the outer adapter wall 36. The cover is then pivoted upward, counter-clockwise in FIG. 7, pivoting about the detent received cam free end portion 90. Continued pivotal movement in this direction engages the shaft portion 92 of the hinge pin 46 against the camming face of the lobe 60, causing a sufficient flexing of the hinge assembly components, for example the outer panel 50, to snap-engage the shaft portion 92 within the detent recess 62 above the shoulder defined by the lobe 60. When so engaged, the cover, noting FIG. 6, is fully mounted and in its maximum open position at approximately 105 degrees to the open top of the container as defined by the adapter or adapter ring 22. In this position, the cover is well clear of the open end of the container for complete access to the contents thereof. At the same time, the cover, through engagement of the pin shaft portion 92 and the cam 88 in opposed detent recesses 62 and 72 respectively, is fixed in position, allowing unencumbered handling of the container without concern for either the cover accidentally closing, as for example when scooping or pouring the contents from the container.

Figure 5:
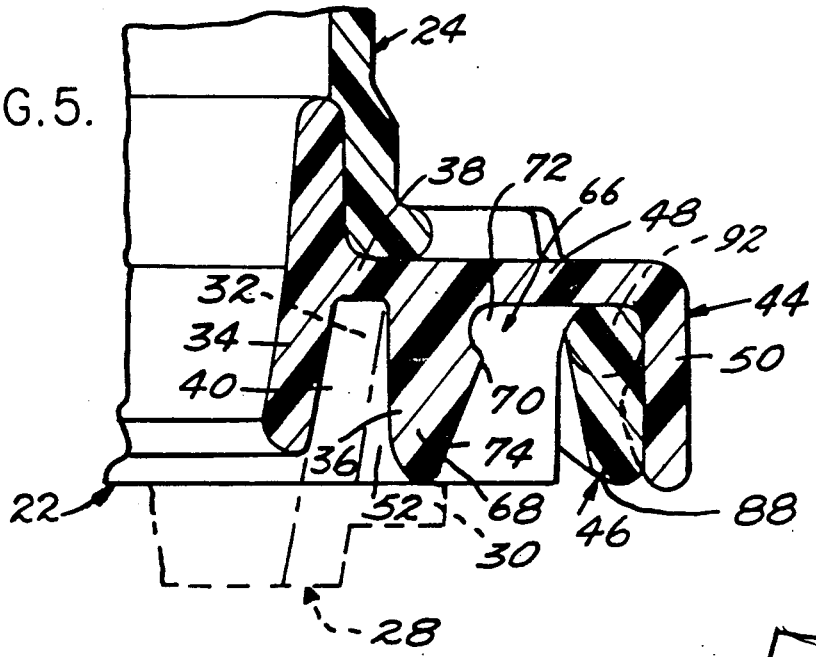
FIG. 5 is an enlarged cross-sectional detail taken substantially on a plane passing along line 5—5 in FIG. 2 and illustrating the hinge components in the closed position of the cover.

In moving the cover 24 to the closed position, the cover, sequentially noting FIGS. 6 and 5, is swung counter-clockwise, pivoting about the pin shaft portion 92 within the detent 62. This pivotal movement, through appropriate manual force, downwardly disengages the cam edge 90 from the corresponding recess 72, the arcuate surface of the projection 68 facilitating this disengagement. Throughout this disengagement of the cam 88, the shaft portion 92 is securely rotatably retained within the corresponding detent 62 above the detent-forming lobe 60. Once the cam edge portion 90 is disengaged from the detent recess 72, the cover freely pivots to its closed position seating on the adapter with the flange skirt intimately engaged with the peripheral upwardly projecting portion of the inner adapter wall 34 peripherally thereabout and seating on the adjacent portion of the adaptor top wall 38. The hinge pin 46, at the same time, will have pivoted to a degree sufficient to position the cam 88 vertically and against or immediately adjacent the inner surface of the outer panel 50 of the hinge seat 44.

A subsequent opening of the container, that is a moving of the cover 24 from the closed position of FIG. 5 to the open position of FIG. 6, is effected by a manual upward and outward pivoting of the cover with the pin shaft 92 rotating within the detent 62 and the cam 88 engaging and moving upwardly along the camming surface of the projection 68 until snap-seating within the detent recess 72. Both the detent-engagement of the cam 88, and the pivotal release thereof, are facilitated by an additional degree of flexibility introduced into the corresponding portion of the adapter outer wall 36 formed so as to leave a slight gap 52 between this wall and the received upper rim portion 32 of the container.

Removal of the cover in its entirety, for cleaning, stacking, or any of a variety of other purposes, while easily effected, requires a positive manual manipulation of the cover such as would preclude accidental or unintentional cover removal. More specifically, and noting FIGS. 6 and 7, the cover 24 is, in a positive manner, rotated clockwise beyond its fully opened position of FIG. 6, pivoting about the detent-engaged cam edge 90 with the pin shaft portion 92 snapping down out of the corresponding detent recess 62 for movement into the lower portion of the slot 58, at which point the cam edge portion 90 will shift out of the associate detent recess 72 for a withdrawal of the shaft portion 92 from the slot 58 and a corresponding withdrawal of the entire pin 46 from the hinge seat 44 through the open bottom thereof.

Figure 4:
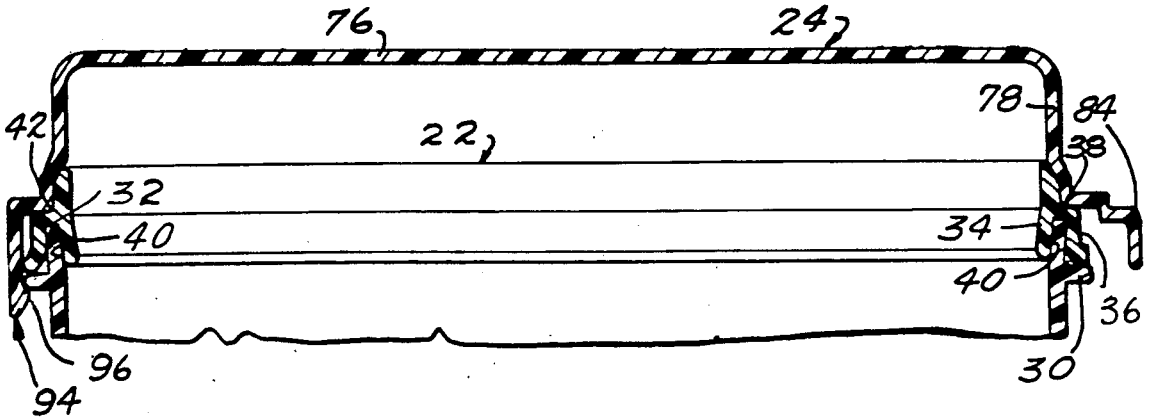
FIG. 4 is an enlarged transverse cross-sectional view taken substantially on a plane passing along line 4—4 in FIG. 1.

Noting FIG. 4, and in particular the left side thereof, it is contemplated that the cover 24 also include an appropriate latch 94 in the nature of an extension integral with, outwardly offset relative to, and depending from the lower edge of the cover 24 diametrically opposed from the hinge assembly. The lower end of the latch 94 includes an inwardly directed lip 96 which releasably snap-engages below either the peripheral container flange 30 or the out-turned lower edge of the outer wall 36 of the adapter 22. Release of the latch is easily effected by a slight manual outward flexing thereof.

From the foregoing, it will be appreciated that the invention comprises a system for providing a hinged cover on an open-topped container without requiring modification of the container itself, and in conjunction therewith, a unique hinge construction which provides for movement of the cover between a closed position and a snap-locked open position. The system further provides for a complete removal of the cover through a positive manual manipulation thereof.

I claim:

1. A closure assembly for a container having an open top defined by a peripheral rim, said closure assembly comprising an adapter ring coextensive with the container rim, means on said adapter ring for mounting and sealing said adapter ring to said container rim, a cover mounted on said adapter ring and moveable between a closed position overlying and closing the open top of the container, and an open position remote from said open top, means for releasably retaining said cover in the closed position, means for releasably retaining said cover in the open position against movement to said closed position, a hinge assembly joining said cover to said adapter ring for pivoted movement between the open and closed positions, said hinge assembly includes pivot pin means on said cover and hinge seat means on said adapter ring, said pivot pin means including cylindrical pin shaft means, said hinge seat means including recess means rotatably receiving said pin shaft means, and said means for releasably retaining said cover in the open position includes cooperating portions on said pivot pin means and on said hinge seat means alignable and releasably interlockable in the open position of the cover whereby positive manual manipulation of the cover relative to the adapter ring is required to release said cooperating portions and move said cover from the closed position thereof.

2. The closure assembly of claim 1 wherein said cooperating portions include cam means on said pivot pin means projecting laterally of said shaft means and rotatable therewith, and detent means on said hinge seat means laterally of said recess means and in the path of the cam means upon rotation of said pin shaft means for releasably receiving and retaining said cam means.

3. The closure assembly of claim 2 including retaining means releasably retaining said pin shaft means in said recess means for selective manual release therefrom and removal from said hinge seat means.

4. A closure assembly for a container having an open top defined by a peripheral rim, said closure assembly comprising an adapter ring coextensive with the container rim, means on said adapter ring for mounting and sealing said adapter ring to said container rim, a cover mounted on said adapter ring and moveable between a closed position overlying and closing the open top of the container, and an open position remote from said open top, means for releasably retaining said cover in the closed position, means for releasably retaining said cover in the open position against movement to said closed position, a hinge assembly joining said cover to said adapter ring for pivoted movement between the open and closed positions, said hinge assembly includes at least one pivot pin on and extending from said cover, and a cooperating pin-receiving hinge seat on said adapter ring.

5. The closure assembly of claim 4 wherein said pivot pin includes a cylindrical pin shaft, said hinge seat comprising a recess rotatably receiving said pin shaft, said means for releasably retaining said cover in the open position comprising a cam projection on said pivot pin extending laterally from said pin shaft for rotation therewith, and a detent on said hinge seat in the path of rotation of said cam projection for receiving and releasably retaining said cam projection in the open position of said cover.

6. The closure assembly of claim 5 wherein said cam projection and said detent are cooperatively configured for rotation of said cam projection within said detent for pivotal swinging of said pin shaft and cover therewith, about said detent-received cam projection, and means for allowing pivotal disengagement of said pin shaft from said recess upon pivotal movement about the detent-engaged cam projection.

7. The closure assembly of claim 6 wherein said hinge seat includes a vertical panel with a free lower edge, a vertical slot defined in said panel through said lower edge, said recess being defined in said slot in upwardly spaced relation to the free lower edge of said panel, said pin shaft being vertically receivable along said slot and into said recess, and shoulder means immediately below said recess for restricting free passage of said pin shaft to and from said recess, said hinge seat incorporating inherent resilient flexibility sufficient to allow manually forced movement of said pin shaft past said shoulder means into and out of said recess, said slot and said shoulder means defining said means for allowing disengagement of said pin shaft from said recess.

8. The closure assembly of claim 7 wherein said recess and said detent are in general horizontal alignment relative to the vertical panel.

9. The closure assembly of claim 8 wherein said cover, upon engagement of said pin shaft and cam projection respectively in the recess and detent, is outwardly positioned at approximately 105 degrees to the open top of the container.

10. A closure assembly for a container having an open top defined by a peripheral rim, said closure assembly comprising an adapter ring coextensive with the container rim, means on said adapter ring for mounting and sealing said adapter ring to said container rim, a cover mounted on said adapter ring and moveable between a closed position overlying and closing the open top of the container, and an open position remote from said open top, means for releasably retaining said cover in the closed position, means for releasably retaining said cover in the open position against movement to said closed position, a hinge assembly joining said cover to said adapter ring for pivoted movement between the open and closed positions, said hinge assembly includes pivot pin means on said cover and hinge seat means on said adapter ring, said pivot pin means including cylindrical pin shaft means, said hinge seat means including recess means rotatably receiving said pin shaft means, said means for mounting and sealing said adapter ring to said container rim comprises laterally spaced inner and outer walls peripherally about said adapter ring, said walls terminating in free lower edges defining a downwardly directed peripheral groove for reception of the container rim upwardly therein, and a top wall transversely interconnecting said inner and outer walls in upwardly spaced relation to the free lower edges thereof.

11. The closure assembly of claim 10 wherein said hinge seat means includes a vertical side panel projecting outward from said outer wall, a vertical slot defined in said side panel in outwardly spaced relation to said outer wall, said slot extending upward through said vertical panel and terminating in an upper-end generally arcuate recess, said pivot pin including a cylindrical shaft receivable upward through said slot and rotatably positionable within said recess, means releasably retaining said cylindrical shaft within said recess, said pivot pin means including a cam projection extending laterally of said shaft for rotation with said shaft between a vertical position depending from said recess in general alignment with said slot, and a generally horizontal position extending from said recess toward the outer wall of the adapter ring, said means for releasably retaining said cover in the open position engaging said cam projection in the generally horizontal position thereof.

12. The closure assembly of claim 11 wherein said means for releasably retaining said cover in the open position comprises a detent extending outward from the outer wall of the adapter ring, and means precluding upward rotational pivoting of said cam projection beyond said detent whereby continued rotational force applied to said pin means produces a reactive pivoting of the pin means about the detent-engaged cam projection and a corresponding downward movement of the pin shaft through said slot for downward removal from said hinge seat means.

13. The closure assembly of claim 12 wherein the outer wall of the adapter ring, along that portion thereof corresponding to the detent, diverges downwardly relative to the corresponding portion of the inner wall of the adapter ring to define a greater width to the corresponding portion of the adapter ring groove adjacent the lower edges of the walls whereby a space is defined between the outer wall portion and a received container rim for flexure of said outer wall portion in response to engagement and disengagement of the cam projection with the detent.

14. A hinge assembly pivotally mounting a cover on an open-top container for movement between a closed position overlying and closing the open top of the container, and an open position remote from said open top, said hinge assembly including at least one pivot pin and a cooperating pin-receiving hinge seat, said pivot pin including a cylindrical pin shaft, said hinge seat comprising a recess rotatably receiving said pin shaft, a cam projection on said pivot pin extending laterally from said pin shaft for rotation therewith, a detent on said hinge seat in the path of rotation of said cam projection for receiving and releasably retaining said cam projection in the open position of said cover, said cam projection and said detent are cooperatively configured for rotation of said cam projection within said detent for pivotal swinging of said pin shaft, and cover therewith, about said detent-received cam projection, and means for allowing pivotal disengagement of said pin shaft from said recess upon pivotal movement about the detent-engaged cam projection.

15. The hinge assembly of claim 14 wherein said hinge seat includes a vertical panel with a free lower edge, a vertical slot defined in said panel through said lower edge, said recess being defined in said slot in upwardly spaced relation to the free lower edge of said panel, said pin shaft being vertically receivable along said slot and into said recess, and shoulder means immediately below said recess for restricting free passage of said pin shaft to and from said recess, said hinge seat incorporating inherent resilient flexibility sufficient to allow manually forced movement of said pin shaft past said shoulder means into and out of said recess.

16. The hinge assembly of claim 15 wherein said recess and said detent are in general horizontal alignment relative to the vertical panel.

17. The hinge assembly of claim 16 wherein said cover, upon engagement of said pin shaft and projection respectively in the recess and detent, is outwardly positioned at approximately 105 degrees to the open top of the container.

18. A hinge assembly pivotally mounting a cover on an open-top container for movement between a closed position overlying and closing the open top of the container, and an open position remote from said open top, said hinge assembly including at least one pivot pin and a cooperating pin-receiving hinge seat, said pivot pin including a cylindrical pin shaft, said hinge seat comprising a recess rotatably receiving said pin shaft, a cam projection on said pivot pin extending laterally from said pin shaft for rotation therewith, a detent on said hinge seat in the path of rotation of said cam projection for receiving and releasably retaining said cam projection in the open position of said cover, said hinge seat includes a vertical side panel, a vertical slot defined in said side panel, said slot extending upward through said vertical panel and terminating at its upper end in said recess, said pin shaft being receivable upward through said slot and rotatably positionable within said recess, and means releasably retaining said pivot pin shaft within said recess.

19. A hinge assembly pivotally joining first and second members for pivotal movement of the first member between a closed position overlying the second member, and an open position remote from said second member, said hinge assembly including pivot pin means on said first member and hinge seat means on said second member, said pivot pin means including cylindrical pin shaft means, said hinge seat means including recess means rotatably receiving said shaft means, said hinge assembly including means remote from said recess means for releasably retaining said first member in the open position against movement to the closed position, said means for releasably retaining said first member in the open position includes cooperating portions on said pivot pin means and on said hinge seat means alignable and releasably interlockable in the open position of the first member whereby positive manual manipulation of the first member relative to the second member is required to release said cooperating portions and move said first member from the open position thereof, said cooperating portions include cam means on said pivot pin means projected laterally of said shaft means and rotatable therewith, and detent means on said hinge seat means laterally of said recess means and in the path of the cam means upon rotation of said shaft means for releasably receiving and retaining said cam means.

20. The hinge assembly of claim 19 including retaining means releasably retaining said shaft means in said recess means for selective manual release therefrom and removal from said hinge seat means.

21. The hinge assembly of claim 20 wherein said cam means and said detent means are cooperatively configured for rotation of said cam means within said detent means for pivotal swinging of said shaft means about said cam means, and means for allowing pivotal disengagement of said shaft means from said recess means upon pivotal movement about said cam means engaged in said detent means.

* * * * *